US011215942B2

(12) United States Patent
Ishikawa et al.

(10) Patent No.: US 11,215,942 B2
(45) Date of Patent: Jan. 4, 2022

(54) IMAGE FORMING APPARATUS, TRANSFER METHOD, AND STORAGE MEDIUM STORING TRANSFER CONTROL PROGRAM

(71) Applicant: KONICA MINOLTA, INC., Tokyo (JP)

(72) Inventors: Remi Ishikawa, Mitaka (JP); Eiji Nishikawa, Tama (JP); Satoshi Miyajima, Hino (JP); Masayuki Fukunaga, Nagareyama (JP)

(73) Assignee: KONICA MINOLTA, INC., Tokyo (JP)

( * ) Notice: Subject to any disclaimer, the term of this patent is extended or adjusted under 35 U.S.C. 154(b) by 79 days.

(21) Appl. No.: 16/773,188

(22) Filed: Jan. 27, 2020

(65) Prior Publication Data

US 2020/0255248 A1 Aug. 13, 2020

(30) Foreign Application Priority Data

Feb. 12, 2019 (JP) ..... JP2019-022233

(51) Int. Cl.
*G03G 15/16* (2006.01)
*B65H 29/16* (2006.01)
(Continued)

(52) U.S. Cl.
CPC ..... *G03G 15/1615* (2013.01); *B65H 29/16* (2013.01); *B65H 43/00* (2013.01);
(Continued)

(58) Field of Classification Search
CPC ..... G03G 15/1615; G03G 15/5054; G03G 2215/16; G03G 2215/0193; G03G 2221/1642; B65H 29/16; B65H 43/00; B65H 2801/06; B65H 2404/2692; B65H 2515/34; B65H 2511/13; B65H 2513/102; B65H 2403/512; B65H 2555/25
See application file for complete search history.

(56) References Cited

U.S. PATENT DOCUMENTS

2018/0039221 A1* 2/2018 Nakamoto ..... G03G 15/754
2020/0379377 A1* 12/2020 Hayakawa ..... G03G 15/162

FOREIGN PATENT DOCUMENTS

EP 3333635 A1 * 6/2018 ..... F16H 25/14
JP 2007286382 A 11/2007
JP 2011133884 A * 7/2011 ..... G03G 15/0189

* cited by examiner

*Primary Examiner* — Ryan D Walsh
(74) *Attorney, Agent, or Firm* — Cantor Colburn LLP

(57) ABSTRACT

An image forming apparatus that has a transfer device that includes an intermediate transfer belt that is tensioned by a plurality of support rollers, a secondary transfer roller that faces one of the support rollers via the intermediate transfer belt, a cam that adjust a pressing force that presses the intermediate transfer belt by the secondary transfer roller, a motor that drives the cam, and a conveyor that conveys a recording medium to a transfer nip formed between the intermediate transfer belt and the secondary transfer roller is provided with a controller that controls an operation of the motor. The controller executes first control of operating the motor with a constant torque and stopping the motor when a rotation angular speed of the motor is less than or equal to a first threshold and second control of operating the motor at a predetermined timing to adjust a transfer nip amount.

19 Claims, 13 Drawing Sheets

Transfer Device (Press-contact state)

(51) Int. Cl.
*B65H 43/00* (2006.01)
*G03G 15/00* (2006.01)

(52) U.S. Cl.
CPC ... *G03G 15/5054* (2013.01); *B65H 2403/512* (2013.01); *B65H 2404/2692* (2013.01); *B65H 2511/13* (2013.01); *B65H 2513/102* (2013.01); *B65H 2515/34* (2013.01); *B65H 2555/25* (2013.01); *B65H 2801/06* (2013.01); *G03G 2215/0193* (2013.01); *G03G 2215/16* (2013.01); *G03G 2221/1642* (2013.01)

IMAGE FORMING APPARATUS, TRANSFER METHOD, AND STORAGE MEDIUM STORING TRANSFER CONTROL PROGRAM

CROSS REFERENCE TO RELATED APPLICATION

The present application claims priority under 35 U.S.C. § 119 to Japanese Patent application No. 2019-022233 filed on Feb. 12, 2019, the entire contents of which being incorporated herein by reference.

BACKGROUND

1. Technological Field

The present invention relates to an image forming apparatus, a transfer method, and a storage medium storing a transfer control program, and in particular, to the image forming apparatus including a transfer device that adjusts a pressing force that presses an intermediate transfer belt by a secondary transfer roller using a cam, the transfer method using the image forming apparatus, and the storage medium storing the transfer control program operating in the image forming apparatus.

2. Description of the Related Art

An image forming apparatus such as a copying machine or an MFP (multi-functional peripherals) that forms an image by an electrophotographic system is configured by an image reader that reads the image from a document, an image processor that processes the read image, an image former that prints the processed image on a recording sheet, a feeder that supplies the recording sheet to the image former, and the like. The image former is configured by a photosensitive drum, a charging device that charges the photosensitive drum, an exposure device that writes an electrostatic latent image on the photosensitive drum, a developing device that visualizes the electrostatic latent image, a transfer device that transfers the visible image on the photosensitive drum to the intermediate transfer belt and then transfers the image on the intermediate transfer belt to a recording medium by the secondary transfer roller, a fixing device that fixes the transferred image, a conveying device that conveys the recording medium, and the like.

A copying operation of the image forming apparatus described above is roughly described. The document placed on a document table is scanned by an optical system of the image reader to be read by an image sensor. A signal from the image sensor is subjected to predetermined image processing or the like in the image processor, and then is sent to the image former. In the image former, laser light is irradiated (exposed) onto the photosensitive drum charged by the charging device based on image data in the exposure device, so that the electrostatic latent image is formed. The electrostatic latent image is visualized by the developing device, and then the visualized image is sequentially transferred (primary transfer) onto the intermediate transfer belt by the transfer device so that a toner image is formed. A recording medium is then fed by the conveying device and conveyed through a feed roller and a registration roller to the transfer device, and the toner image on the intermediate transfer belt is transferred (secondary transfer) to the recording medium by the secondary transfer roller. Thereafter, the recording medium is heated and pressurized in the fixing device, and then is output with the transferred toner image fixed thereon.

Here, during the secondary transfer described above, when the recording medium enters a portion formed between the secondary transfer roller and the intermediate transfer belt (referred to as "transfer nip"), loads on the secondary transfer roller and the intermediate transfer belt change abruptly to fluctuate a speed of the intermediate transfer belt, so that image disturbance (shock noise) occurs. Consequently, there has been proposed a method of reducing the shock noise by separating the intermediate transfer belt from the secondary transfer roller before the recording medium enters the transfer nip and press-contacting the intermediate transfer belt and the secondary transfer roller after the recording medium enters the transfer nip.

For example, Unexamined Japanese Patent Publication No. 2007-286382 discloses a transfer device that includes an endless intermediate transfer belt that is endlessly moved while being tensioned by a plurality of tension rollers and a transfer nip forming roller that abuts against a portion of the belt where a nip back-side tensioning roller functioning as one of the tension rollers is put around at the belt front surface side to form a transfer nip for a recording member, and that transfers a visible image developed on a surface of a latent image carrier from the surface to a front surface of the intermediate transfer belt and then transfers the visible image on the intermediate transfer belt to a recording member nipped in the transfer nip. In the transfer device, a structure that includes an abutting member that abuts against at least any one of the tension rollers or the intermediate transfer belt, a pressing force adjusting means that adjusts a pressing force of the abutting member on the tension member or the intermediate transfer belt, and a pressing force controller that, when the recording member enters the transfer nip, controls the pressing force adjusting means so as to reduce the pressing force less than a pressing force immediately before the recording member enters the transfer nip, or that, when a trailing end of the recording member is discharged from the transfer nip, controls the pressing force adjusting means so as to increase the pressing force more than a pressing force immediately before the trailing edge of the recording member is discharged from the transfer nip is disclosed. In addition, Unexamined Japanese Patent Publication No. 2007-286382 describes that a thickness information acquisition means that acquires thickness information of the recording member is provided, and control of causing a degree of change in the pressing force when the recording member enters the transfer nip or when the trailing end of the recording member is discharged from the transfer nip to be changed depending on the thickness information is executed.

SUMMARY

As the amount of separation between the intermediate transfer belt and the secondary transfer roller is adjusted depending on a sheet thickness in the conventional technique described above, it is necessary to separately provide a means for detecting the sheet thickness. In addition, there is a problem that, depending on the sheet thickness, the pressing force cannot be changed within a certain period of time during which the recording medium enters the transfer nip or is discharged from the transfer nip, and thus a transfer nip amount (distance between the secondary transfer roller and the intermediate transfer belt) is unstable.

In order to solve such a problem, there has been known a technique called cam abutment where in a structure of driving the secondary transfer roller using a cam, the cam is operated at a low current for a certain period of time to abut against the secondary transfer roller, and fine adjustment of a pressure (fine pressure operation) is performed from the point of time when torques are balanced (constant) so as to stabilize the transfer nip amount.

However, as a motor that starts the cam has variations in torque, the motor may not be able to start by itself at a fixed low current. Furthermore, when the cam abuts against the roller, the output torque of the motor may become larger than expected and thus the transfer nip amount may become smaller than expected. Alternatively, whether the cam abuts against the roller is determined by time, and thus the fine pressure operation may start in a state where the cam has not abut against the roller.

Meanwhile, if only encoder control based on a rotation angle of the motor is executed without executing torque control described above, the motor stops before the cam reaches the secondary transfer roller due to variations in the sheet thickness, so that the fine pressure operation may not be stable.

In addition, if a current flowing into the motor is increased, an impact at the time of cam abutment may increase and images may be disturbed. Moreover, as the motor is operated at a high speed, the encoder control lags behind, and thus the transfer nip amount may become smaller than expected.

The present invention has been achieved in view of the above problems, and a main object of the present invention is to provide an image forming apparatus, a transfer method, and a storage medium storing the transfer control program that can reduce influence of motor torque variations and sheet thickness variations, appropriately adjust the transfer nip amount when the recording medium enters the transfer nip or is discharged from the transfer nip, and prevent image abnormalities due to fluctuations in the transfer nip amount.

To achieve at least one of the abovementioned objects, according to an aspect of the present invention, the image forming apparatus, the transfer method, and the storage medium storing the transfer control program reflecting one aspect of the present invention comprise the following.

The image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, and a conveyor that conveys a recording medium to a transfer nip formed between said intermediate transfer belt and said secondary transfer roller, said image forming apparatus comprising: a detector that detects a rotation angle of said motor; and a hardware processor that controls an operation of said motor, wherein said hardware processor executes first control of operating said motor with a constant torque and stopping said motor when a rotation angular speed of said motor is less than or equal to a first threshold determined in advance and second control of operating said motor at a predetermined timing to adjust a transfer nip amount.

The transfer method in an image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, a detector that detects a rotation angle of said motor, and a conveyor that conveys a recording medium to a transfer nip formed between said intermediate transfer belt and said secondary transfer roller, said transfer method comprising: performing first processing of operating said motor with a constant torque and stopping said motor when a rotation angular speed of said motor is less than or equal to a first threshold determined in advance; and performing second processing of operating said motor at a predetermined timing to adjust a transfer nip amount.

The non-transitory computer-readable storage medium storing a transfer control program operating in an image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, a detector that detects a rotation angle of said motor, a controller that controls an operation of said motor, and a conveyor that conveys a recording medium to a transfer nip formed between said intermediate transfer belt and said secondary transfer roller, said transfer control program causing said controller to perform:

first processing of operating said motor with a constant torque and stopping said motor when a rotation angular speed of said motor is less than or equal to a first threshold determined in advance; and second processing of operating said motor at a predetermined timing to adjust a transfer nip amount.

The objects, features, and characteristics of this invention other than those set forth above will become apparent from the description given herein below with reference to preferred embodiments illustrated in the accompanying drawings.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
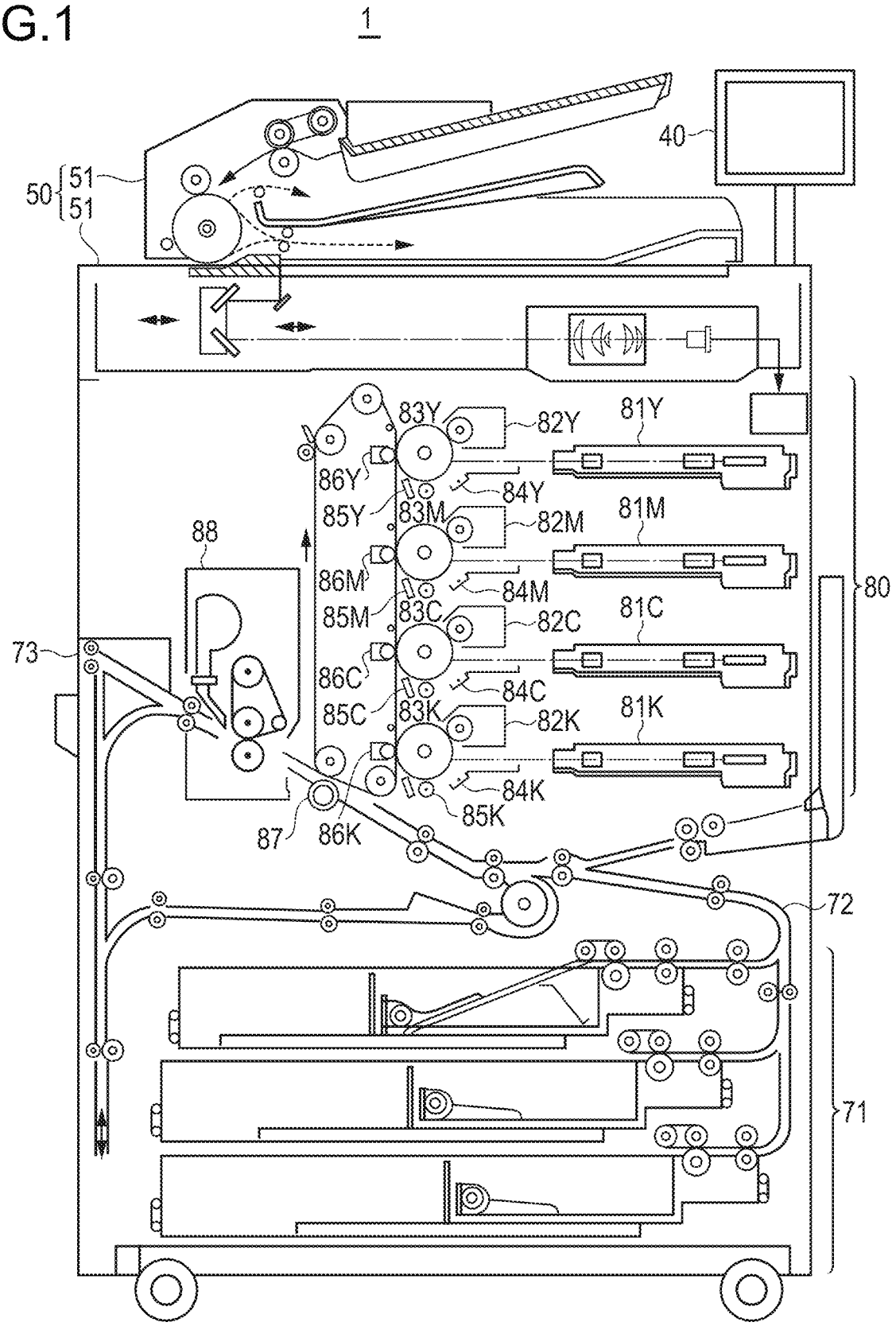
FIG. 1 is a cross-sectional view illustrating an overall configuration of an image forming apparatus according to an embodiment of the present invention.

Hereinafter, one or more embodiments of the present invention will be described with reference to the drawings. However, the scope of the invention is not limited to the disclosed embodiments.

As described in the background, in an image forming apparatus such as an MFP that forms an image by an electrophotographic system, during secondary transfer, when a recording medium enters a transfer nip formed between a secondary transfer roller and an intermediate transfer belt, loads on the secondary transfer roller and the intermediate transfer belt change abruptly, so that image disturbance (shock noise) occurs. Consequently, there has been proposed a method of reducing the shock noise by separating the intermediate transfer belt from the secondary transfer roller before the recording medium enters the transfer nip at for the secondary transfer and press-contacting the intermediate transfer belt and the secondary transfer roller after the recording medium enters the transfer nip.

However, in this method, the amount of separation between the intermediate transfer belt and the secondary transfer roller is adjusted depending on a sheet thickness, and thus it is necessary to separately provide a means for detecting the sheet thickness. In addition, there is a problem that, depending on the sheet thickness, a pressing force cannot be changed within a certain period of time during which the recording medium enters the transfer nip or is discharged from the transfer nip, and thus a transfer nip amount is unstable.

In order to solve such a problem, there has been known a cam abutment technique where in a structure of driving a secondary transfer roller using a cam (high-speed pressure separating cam), the high-speed pressure separating cam is operated at a low current for a certain period of time, and fine adjustment (fine pressure operation) is performed from the point of time when torques are balanced so as to stabilize the transfer nip amount. However, as a motor that starts the cam has variations in torque, the motor may not be able to start by itself at a fixed low current. Furthermore, when the cam abuts against the roller, the output torque of the motor may become larger than expected and thus the transfer nip amount may become smaller than expected. Alternatively, the fine pressure operation may start in a state where the cam has not abut against the roller.

Meanwhile, if only encoder control based on a rotation angle of the motor is executed without executing torque control described above, the motor stops before the high-speed pressure separating cam reaches the secondary transfer roller due to variations in the sheet thickness, so that the fine pressure operation may not be stable. In addition, if a current flowing into the motor is increased, an impact at the time of cam abutment may increase and images may be disturbed. Moreover, as the motor is operated at a high speed, the encoder control lags behind, and thus the transfer nip amount may become smaller than expected.

According to an aspect of the present invention, an operation of the motor that starts the cam is controlled by combining the torque control and the encoder control. Specifically, an image forming apparatus that has a transfer device that includes an intermediate transfer belt that is tensioned by a plurality of support rollers, a secondary transfer roller that faces one of the support rollers with the intermediate transfer belt interposed between the one of the support roller and the secondary transfer roller, a cam that can adjust a pressing force that presses the intermediate transfer belt by the secondary transfer roller, a motor that drives the cam, and a conveyor that conveys the recording medium to the transfer nip formed between the intermediate transfer belt and the secondary transfer roller is provided with a detector that detects the rotation angle of the motor and a controller that controls an operation of the motor. The controller executes first control of operating the motor with a constant torque and stopping the motor when a rotation angular speed of the motor is less than or equal to a first threshold determined in advance and second control of operating the motor at a predetermined timing to adjust the transfer nip amount.

Consequently, influence of motor torque variations and sheet thickness variations can be reduced, the transfer nip amount when the recording medium enters the transfer nip or is discharged from the transfer nip can be adjusted appropriately, and image abnormalities due to fluctuations in the transfer nip amount can be prevented.

Embodiment

Figure 2A:
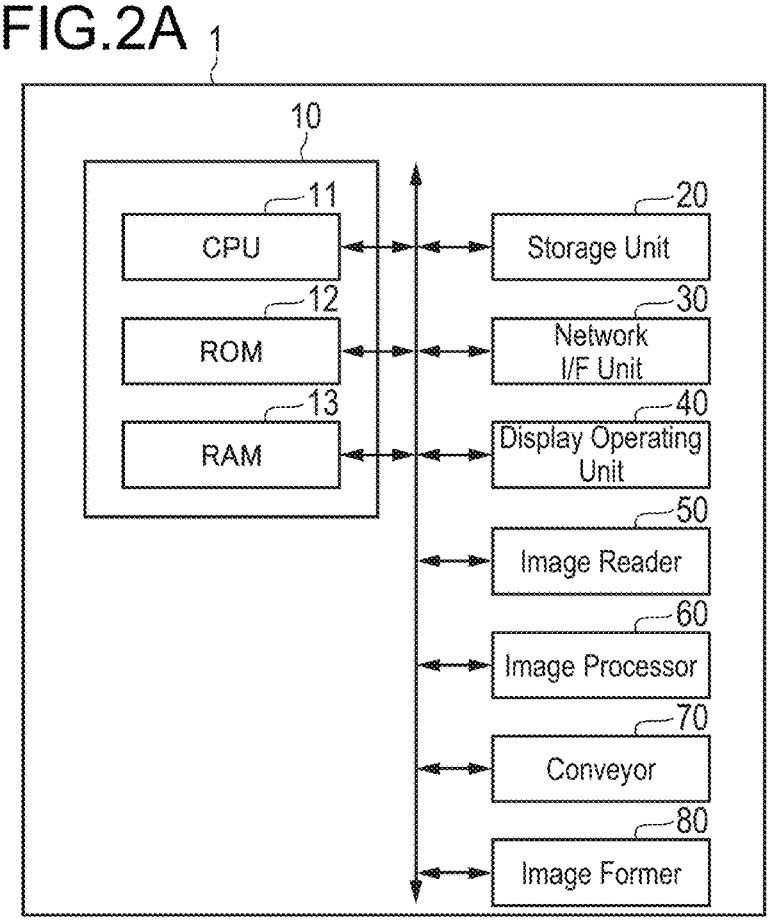
FIG. 2A to FIG. 2C are block diagrams illustrating a configuration of the image forming apparatus according to an embodiment of the present invention.
Figure 2B:
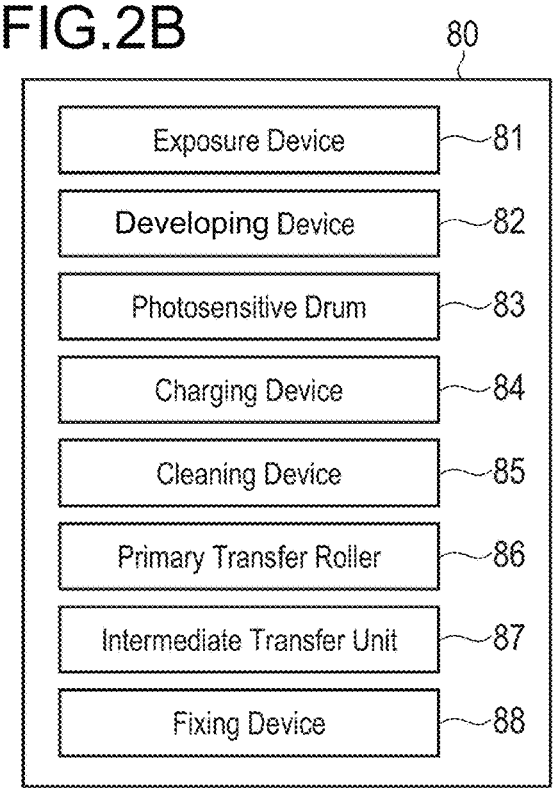
Figure 2C:
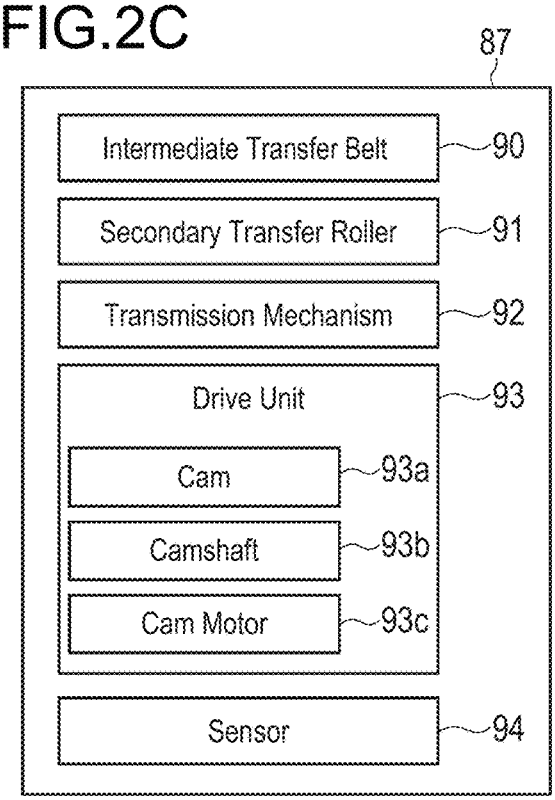
Figure 3:
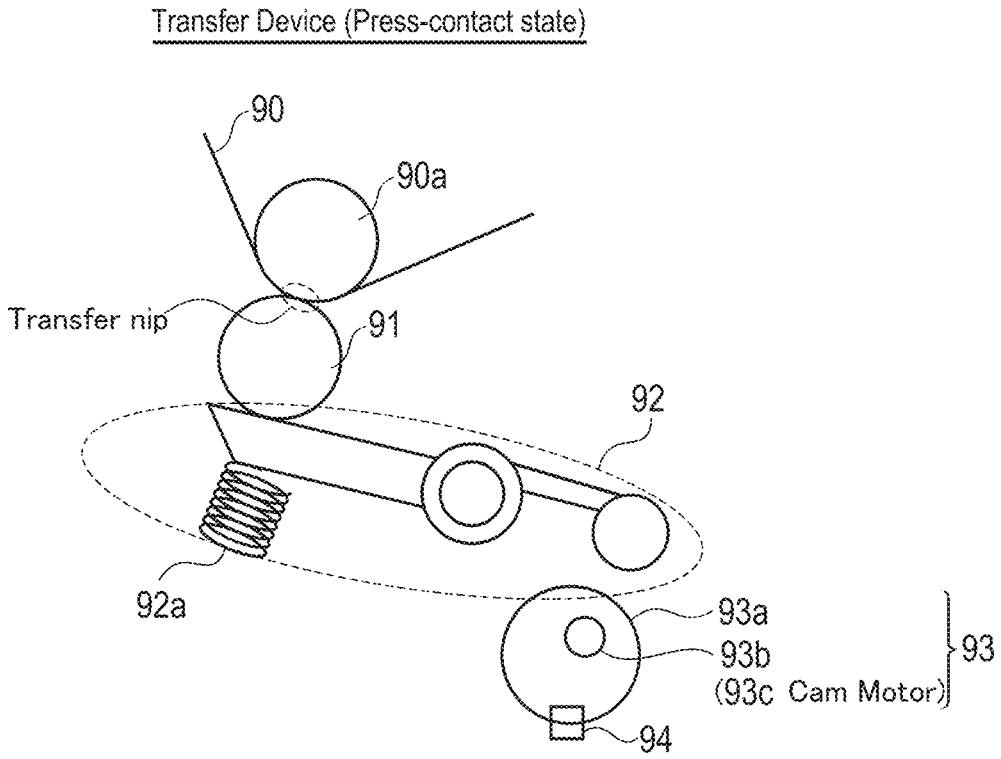
FIG. 3 is a schematic view illustrating a pressure-contact state of a transfer device in the image forming apparatus according to an embodiment of the present invention.
Figure 4:
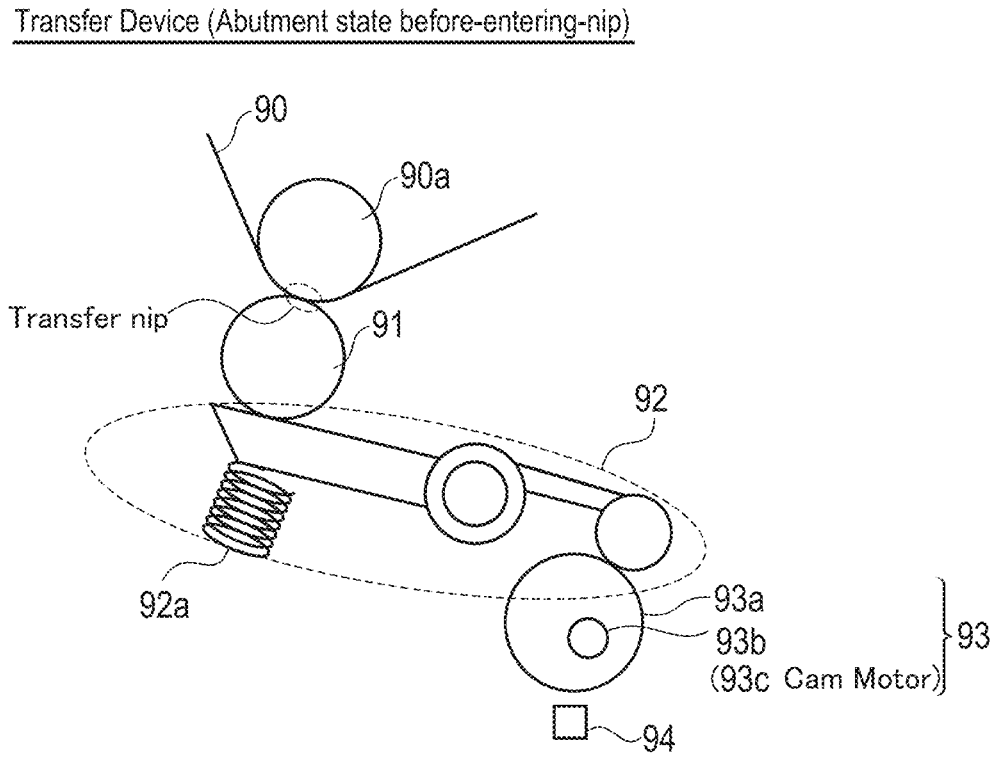
FIG. 4 is a schematic view illustrating an abutment state before-entering-nip of the transfer device in the image forming apparatus according to an embodiment of the present invention.
Figure 5:
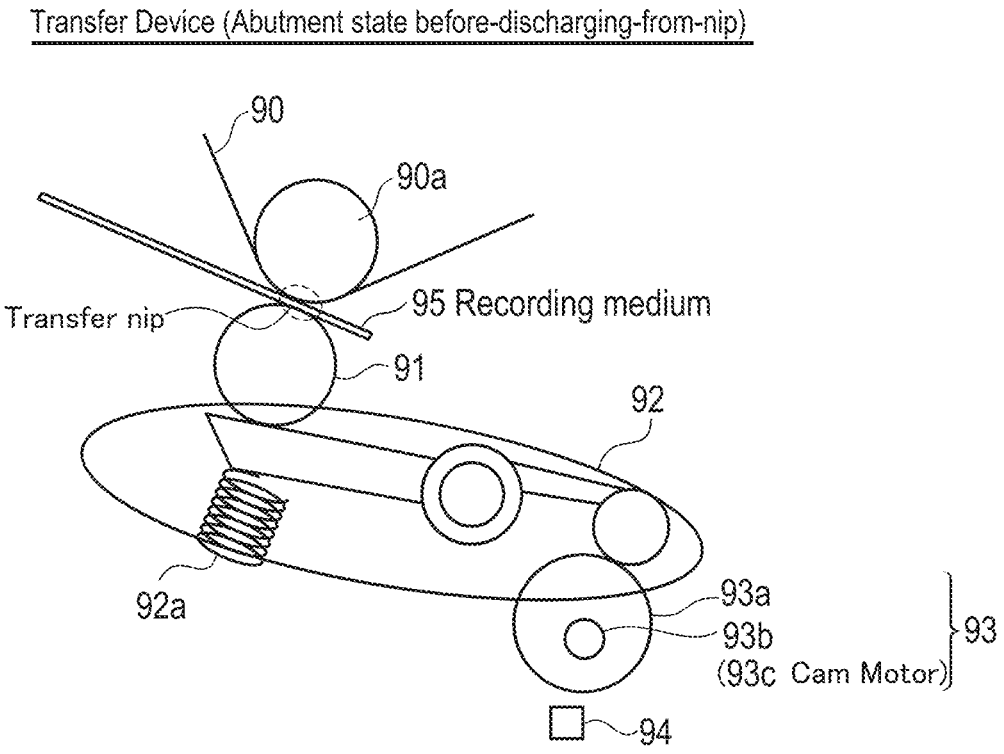
FIG. 5 is a schematic view illustrating an abutment state before-discharging-from-nip of the transfer device in the image forming apparatus according to an embodiment of the present invention.
Figure 6:
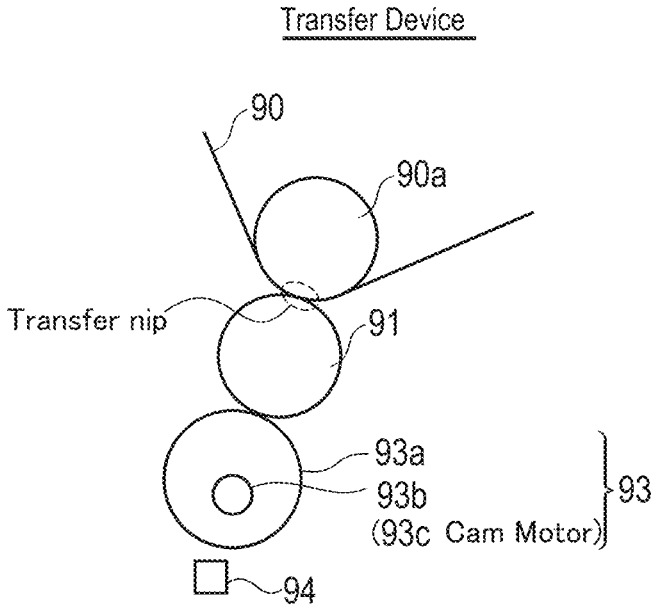
FIG. 6 is a schematic view illustrating another configuration of the transfer device according to an embodiment of the present invention.
Figure 7:
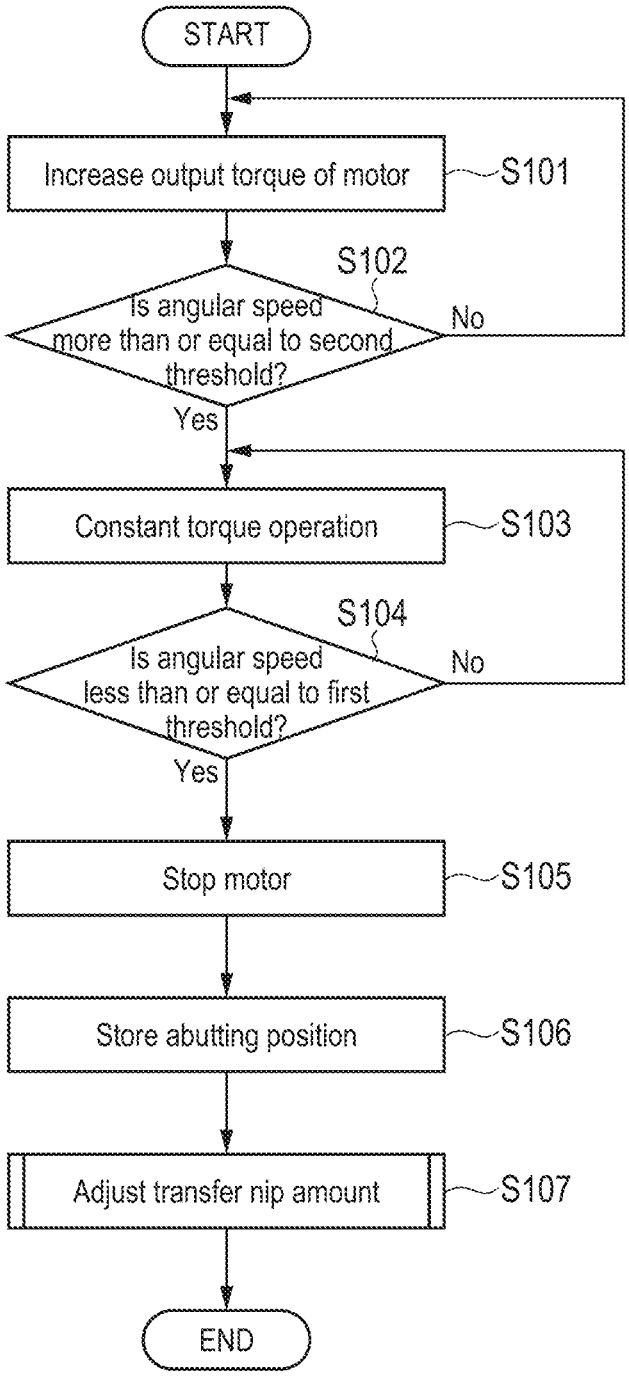
FIG. 7 is a flowchart illustrating an operation of the transfer device according to an embodiment of the present invention.
Figure 8:
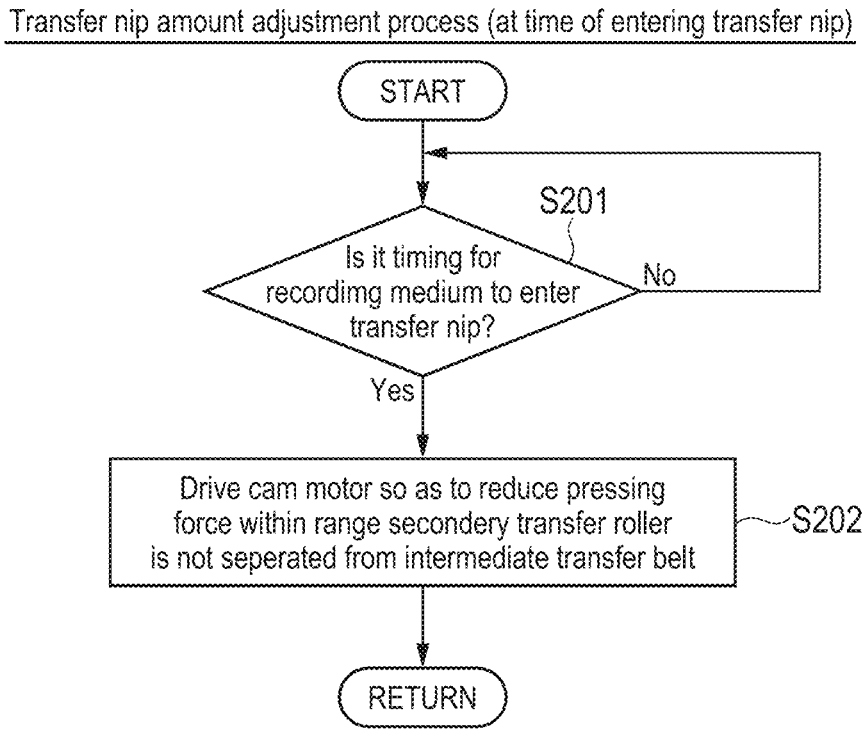
FIG. 8 is a flowchart illustrating an operation of the transfer device according to an embodiment of the present invention (transfer nip amount adjustment process at a time of entering a transfer nip)
Figure 9:
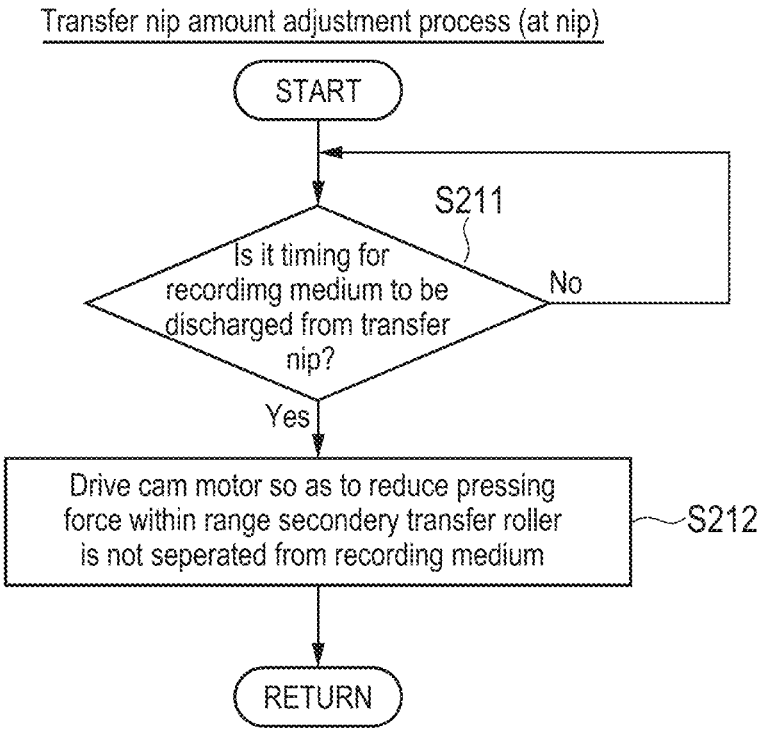
FIG. 9 is a flowchart illustrating an operation of the transfer device according to an embodiment of the present invention (transfer nip amount adjustment process at a nip)

In order to describe the embodiment of the present invention described above in further detail, an image forming apparatus, a transfer method, and a transfer control program according to an embodiment of the present invention will be described with reference to FIG. 1 to FIG. 13. FIG. 1 is a cross-sectional view illustrating an overall configuration of an image forming apparatus according to the present embodiment, and FIG. 2A to FIG. 2C are block diagrams illustrating the configuration of the image forming apparatus. FIG. 3 to FIG. 5 are schematic views illustrating a state of a transfer device in the image forming apparatus according to the present embodiment, and FIG. 6 is a schematic view illustrating another configuration of the transfer device. FIG. 7 to FIG. 9 are flowcharts illustrating an operation of the transfer device according to the present embodiment, and FIG. 10 to FIG. 13 are graphs for explaining the transfer method in the transfer device according to the present embodiment.

As illustrated in FIG. 1, the image forming apparatus 1 according to the present embodiment is an apparatus that forms the image by superimposing colors on a sheet based on image data acquired by reading a document or image data input from an external information device (for example, client device) via a communication network, and is, for example, a tandem type image forming apparatus in which photosensitive drums 83Y, 83M, 83C, and 83K functioning as photosensitive bodies corresponding to four colors, that is, yellow (Y), magenta (M), cyan (C), and black (K) are arranged in series in a traveling direction of a transferred body (intermediate transfer belt).

As illustrated in FIG. 2A, the image forming apparatus 1 is configured by a controller 10, a storage unit 20, a network I/F unit 30, a display operating unit 40, an image reader 50, an image processor 60, a conveyor 70, an image former 80, and the like.

The controller 10 is configured by a CPU (Central Processing Unit) 11 and memories such as a ROM (Read Only Memory) 12 and a RAM (Random Access Memory) 13. The CPU 11 reads a program corresponding to a processing content from the ROM 12 or the storage unit 20, expands the program into the RAM 13, and executes the program to control, in a centralized manner, operations of the respective blocks of the image forming apparatus 1 (display operating unit 40, image reader 50, image processor 60, conveyor 70, image former 80, and the like).

In particular, the controller 10 controls an operation of the motor that drives the cam that adjusts a pressing force that presses the intermediate transfer belt by the secondary transfer roller. The control of the motor includes first control and second control. The first control (first processing) and the second control (second processing) are performed by the CPU 11 executing a transfer control program.

In the first control, the controller 10 operates the motor with the constant torque, and stops the motor when the rotation angular speed of the motor is less than or equal to the predetermined threshold (first threshold). In this case, the motor is driven with a torque when the rotation angular speed of the motor is more than or equal to a predetermined threshold (second threshold determined depending on sheet size or inter-sheet time). When the rotation angular speed of the motor at a predetermined time is less than a past rotation angular speed stored in advance, it is determined that the cam abuts against the secondary transfer roller or a transmission mechanism to be described later, and the motor is stopped. The first control is executed before the recording medium enters the transfer nip and/or in a state where the recording medium is nipped between the intermediate transfer belt and the secondary transfer roller.

In the second control, the controller 10 adjusts the transfer nip amount by operating the motor at a predetermined timing. In this case, when the first control is executed before the recording medium enters the transfer nip, in the second control, immediately before the recording medium enters the transfer nip, within a range that the secondary transfer roller is not separated from the intermediate transfer belt, the motor is driven so as to reduce the pressing force that presses the intermediate transfer belt by the secondary transfer roller. In addition, when the first control is executed in the state where the recording medium is nipped between the intermediate transfer belt and the secondary transfer roller, in the second control, immediately before the recording medium is discharged from the transfer nip, within a range that the secondary transfer roller is not separated from the recording medium, the motor is driven so as to reduce the pressing force.

The storage unit 20 is configured by an HDD (Hard Disk Drive), an SSD (Solid State Drive), or the like, and stores a program for the CPU 11 to control each unit, information about a processing function of the own apparatus, image data read by the image reader 50, image data input from a client device (not illustrated) or the like, thresholds for controlling the operation of the motor (first threshold and second threshold described above), the rotation angular speed of the motor when the first control was executed in the past, and the like.

The network I/F unit 30 is configured by an NIC (Network Interface Card), a modem, and the like, and connects the image forming apparatus 1 to a communication network such as a LAN (Local Area Network) or a WAN (Wide Area Network) to transmit and receive various data to and from an external information device (for example, client device).

The display operating unit 40 is configured by a touch panel or the like where, for example, a pressure-sensitive or capacitance operating unit (touch sensor) configured by transparent electrodes arranged in a grid is disposed on a display unit such as an LCD (Liquid Crystal Display) or an organic EL (Electro Luminescence) display, and functions as a display unit and an operating unit. The display unit displays various operation screens, an image status, an operation state of each function, and the like in response to a display control signal input from the controller 10. The operating unit receives various input operations by a user and outputs an operation signal to the controller 10.

The image reader 50 is configured by an automatic document feeder 51 called an ADF (Auto Document Feeder), a document image scanning device (scanner) 52, and the like. The automatic document feeder 51 conveys a document placed on a document tray by a conveying mechanism to send the document to the document image scanning device 52. The document image scanning device 52 optically scans the document conveyed on a contact glass from the automatic document feeder 51 or the document placed on the contact glass, forms images by light reflected from the document on a light receiving surface of a CCD (Charge Coupled Device) sensor, and reads a document image. The image (analog image signal) read by the image reader 50 is subjected to predetermined image processing in the image processor 60.

The image processor 60 is configured by a circuit that performs an analog-to-digital (A/D) conversion process, a circuit that performs digital image processing, and the like. The image processor 60 generates digital image data by performing the A/D conversion process on the analog image signal from the image reader 50. Further, the image processor 60 also generates digital image data by analyzing a print job acquired from an external information device (for example, client device) and rasterizing each page of the document. The image processor 60 then performs image processing such as a color conversion process, an initial setting or a correction process (shading correction or the like) according to user settings, and a compression process on the image data as necessary, and outputs the image data subjected to the image processing to the image former 80.

As illustrated in FIG. 1, the conveyor 70 is configured by a sheet feeder 71, a conveying mechanism 72, a sheet discharger 73, and the like. In the present embodiment, the sheet feeder 71 includes three sheet feeding tray units. In these sheet feeding tray units, standard sheets and special sheets identified based on a basis weight, a size, or the like of a sheet are stored for each preset type. The sheets stored in the sheet feeding tray unit are sent one by one from the top and conveyed to the image former 80 by the conveying mechanism 72 having a plurality of conveying rollers such as registration rollers. In this case, a registration unit provided with the registration rollers corrects an inclination of a fed sheet and adjusts a conveyance timing. A sheet on which an image is formed by the image former 80 is discharged to a sheet discharge tray provided outside the apparatus by the sheet discharger 73 having a sheet discharge roller.

As illustrated in FIG. 1 and FIG. 2B, the image former 80 is configured by including exposure devices 81 (81Y, 81M, 81C, 81K), developing devices 82 (82Y, 82M, 82C, 82K), photosensitive drums 83 (83Y, 83M, 83C, 83K), charging devices 84 (84Y, 84M, 84C, 84K), cleaning devices 85 (85Y, 85M, 85C, 85K), and primary transfer rollers 86 (86Y, 86M, 86C, 86K) that are provided corresponding to different color components Y, M, C, and K, an intermediate transfer unit 87, a fixing device 88, and the like. In the following description, reference numerals without Y, M, C, and K are used as necessary.

The photosensitive drum 83 of each color component Y, M, C, and K is an image carrier obtained by forming an organic photosensitive layer (OPC) provided with an overcoat layer as a protective layer on an outer peripheral surface of a cylindrical metal base made of an aluminum material. The photosensitive drum 83 is, in a grounded state, rotated in a counterclockwise direction in FIG. 1 following an operation of an intermediate transfer belt to be described later.

The charging device 84 of each color component Y, M, C, and K is, for example, a scorotron type charging device, and is disposed close to the corresponding photosensitive drum 83 with its longitudinal direction aligned with a rotation axis direction of the photosensitive drum 83, and applies a uniform potential to a surface of the photosensitive drum 83 by corona discharge at the same polarity as toner.

The exposure device 81 of each color component Y, M, C, and K scans the surface of the corresponding photosensitive drum 83 that is uniformly charged in parallel with a rotation axis of the photosensitive drum 83 using, for example, a polygon mirror to perform image exposure based on image data, so that an electrostatic latent image is formed.

The developing device 82 of each color component Y, M, C, and K stores a two-component developer composed of small particle size toner of a corresponding color component and a magnetic material. The toner is conveyed on the surface of the photosensitive drum 83 to visualize the electrostatic latent image carried on the photosensitive drum 83.

The primary transfer roller 86 of each color component Y, M, C, K causes the intermediate transfer belt to press-contact the photosensitive drum 83, so that the respective color toner images formed on the corresponding photosensitive drums 83 are sequentially superimposed and primarily transferred to the intermediate transfer belt.

The cleaning device 85 of each color component Y, M, C, and K collects residual toner remaining on the corresponding photosensitive drum 83 after the primary transfer. Further, a lubricant application mechanism (not illustrated) is disposed adjacent to the cleaning device 85 on a downstream side in a rotating direction of the photosensitive drum 83, and a lubricant is applied to a photosensitive surface of the corresponding photosensitive drum 83.

The intermediate transfer unit 87 includes the endless intermediate transfer belt functioning as a transferred body, a support roller, a secondary transfer roller, an intermediate transfer cleaning unit, and the like, and is configured such that the intermediate transfer belt is tensioned by a plurality of support rollers. When the intermediate transfer belt to which the respective color toner images are primarily transferred by the primary transfer rollers 86Y, 86M, 86C, and 86K is press-contacted the sheet by the secondary transfer roller, the toner images are secondarily transferred to the sheet at a press-contact portion (transfer nip), and the sheet is sent to the fixing device 88. The intermediate transfer cleaning unit includes a belt cleaning blade (BCL blade) that slide-contacts a surface of the intermediate transfer belt. Transfer residual toner remaining on the surface of the intermediate transfer belt after the secondary transfer is scraped off and removed by the BCL blade. A detailed configuration and operation of this intermediate transfer unit will be described later.

The fixing device 88 includes a heating roller functioning as a heat source, a fixing roller, a fixing belt which put around these rollers, a pressure roller, and the like, and the pressure roller press-contacts the fixing roller with the fixing belt interposed between these rollers. The sheet passing through the press-contact portion (fixing nip) is then heated and pressed by the fixing belt heated by the heating roller and each roller to fix an unfixed toner image formed on the sheet.

The sheet on which the toner image is fixed by the fixing device 88 is discharged to the sheet discharge tray provided outside the apparatus by the sheet discharger 73 having a sheet discharge roller.

Next, a configuration of the transfer device (intermediate transfer unit 87) in the image forming apparatus 1 according to the present embodiment will be described. As illustrated in FIG. 2C and FIG. 3 to FIG. 5, the transfer device (intermediate transfer unit 87) of the present embodiment is configured by the endless intermediate transfer belt 90 tensioned by a plurality of support rollers 90*a*, a belt drive motor (not illustrated) that drives the intermediate transfer belt 90, a secondary transfer roller 91 that faces one support roller 90*a* with the intermediate transfer belt 90 being interposed therebetween, a drive unit 93 that includes a cam 93*a*, a camshaft 93*b* functioning as a rotation shaft of the cam 93*a*, and a cam motor 93*c* (not illustrated) that is connected to the camshaft 93*b* directly or via a gear or the like to rotate the cam 93*a*, a transmission mechanism 92 that transmits power of the drive unit 93 to the secondary transfer roller 91, a detector (sensor 94) that detects the rotation angle of the cam motor, and the like. Further, in the transmission mechanism 92, one end of a rotatably supported member is disposed at a position where the one end can abut against the cam 93*a* and the other end of the member is disposed at a position where the other end can abut against the secondary transfer roller 91. The transmission mechanism 92 includes a coil spring 92*a* that causes the secondary transfer roller 91 to generate a pressing force via the other end. Moreover, a sensor (not illustrated) or the like for detecting a position of the sheet is disposed in a sheet conveying path, and a timing at which the sheet enters the transfer nip and a timing at which the sheet is discharged from the transfer nip can be specified based on a signal from the sensor. Then, by rotating the cam 93*a* at a predetermined timing, the secondary transfer roller 91 moves in a direction in which the secondary transfer roller 91 press-contacts or is separated from the intermediate transfer belt 90 via the transmission mechanism 92, so that the pressing force that presses the intermediate transfer belt 90 by the secondary transfer roller 91 changes.

Specifically, as illustrated in FIG. 3, when the cam 93*a* does not abut against the one end of the transmission mechanism 92 described above, the other end of the transmission mechanism 92 presses the secondary transfer roller 91 by the coil spring 92*a*, the secondary transfer roller 91 thus press-contacts the intermediate transfer belt 90, and the transfer nip is formed at a portion sandwiched between the intermediate transfer belt 90 and the secondary transfer roller 91.

Moreover, before the recording medium enters the transfer nip, as illustrated in FIG. 4, the cam 93*a* rotates to abut against the one end of the transmission mechanism 92 (abutment state before-entering-nip), the other end of the transmission mechanism 92 presses the coil spring 92*a*, and thus the pressing force that presses the intermediate transfer belt 90 by the secondary transfer roller 91 is reduced.

Further, when the recording medium is nipped between the intermediate transfer belt 90 and the secondary transfer roller 91, as illustrated in FIG. 5, the cam 93*a* further rotates to press the one end of the transmission mechanism 92 (abutment state before-discharging-from-nip), the other end of the transmission mechanism 92 presses the coil spring 92*a*, and thus the pressing force that presses the intermediate transfer belt 90 by the secondary transfer roller 91 is reduced.

In such a configuration, the conventional transfer method has problems that the torque of the cam motor 93*c* in the abutment state becomes larger than expected and thus the transfer nip amount is smaller than expected, a fine pressure operation starts in a state where the cam 93*a* has not abutted against the one end, and the cam motor 93*c* stops before the cam 93*a* abuts against the one end.

Therefore, in the present embodiment, the controller 10 that controls the cam motor 93*c* executes first control of operating the cam motor 93*c* with the constant torque and stopping the cam motor 93*c* when the rotation angular speed of the cam motor 93*c* is less than or equal to the predetermined first threshold and second control of operating the cam motor 93*c* to adjust the transfer nip amount. For example, the first control is executed before the recording medium enters the transfer nip, in the second control, immediately before the recording medium enters the transfer nip, within the range that the secondary transfer roller 91 is not separated from the intermediate transfer belt 90, the cam motor 93*c* is driven so as to reduce the pressing force that presses the intermediate transfer belt 90 by the secondary transfer roller 91. Further, the first control is executed in a state where the recording medium is nipped between the intermediate transfer belt 90 and the secondary transfer roller 91, in the second control, immediately before the recording medium is discharged from the transfer nip, within the range that the secondary transfer roller 91 is not separated from the recording medium, the cam motor 93*c* is driven so as to reduce the pressing force described above.

In FIG. 3 to FIG. 5, the transfer device (intermediate transfer unit 87) is configured by the intermediate transfer belt 90, the secondary transfer roller 91, the drive unit 93 including the cam 93*a*, the camshaft 93*b*, and the cam motor 93*c*, the transmission mechanism 92, and the sensor 94. However, as illustrated in FIG. 6, the transfer device (intermediate transfer unit 87) may be configured by the intermediate transfer belt 90, the secondary transfer roller 91, the drive unit 93 including the cam 93*a*, the camshaft 93*b*, and the cam motor 93*c*, and the sensor 94, and may directly apply drive force of the drive unit 93 to the secondary transfer roller 91 without via the transmission mechanism. Further, the shape, structure, and arrangement of the cam 93*a* and the transmission mechanism 92 are not limited to those illustrated in the drawings. The structure of the sensor 94 is not particularly limited, and for example, a rotation angle sensor that detects a change in reactance of a rotating rotor and a fixed stator, or the like may be used.

Hereinafter, an operation of the transfer device (intermediate transfer unit 87) of the present embodiment will be described with reference to FIG. 7 to FIG. 9. The CPU 11 of the controller 10 expands the transfer control program stored in the ROM 12 or the storage unit 20 into the RAM 13 and executes the transfer control program, thus performing processes at the respective steps illustrated in the flowcharts of FIG. 7 to FIG. 9. It is assumed that the controller 10 monitors an output from the sensor 94, and monitors the rotation angular speed (hereinafter simply referred to as "angular speed") of the cam motor 93*c*.

As the first control, the controller 10 first increases output torque by increasing the current flowing into the cam motor 93*c* (S101), and determines whether the angular speed of the cam motor 93*c* is more than or equal to the predetermined threshold (second threshold) (S102). When the angular speed of the cam motor 93*c* is less than the second threshold (No at S102), the process returns to S101 and then the output torque is increased. On the other hand, when the angular speed of the cam motor 93*c* is more than or equal to or the second threshold (Yes at S102), the cam motor 93*c* is operated with the output torque at that time (S103).

Figure 12:
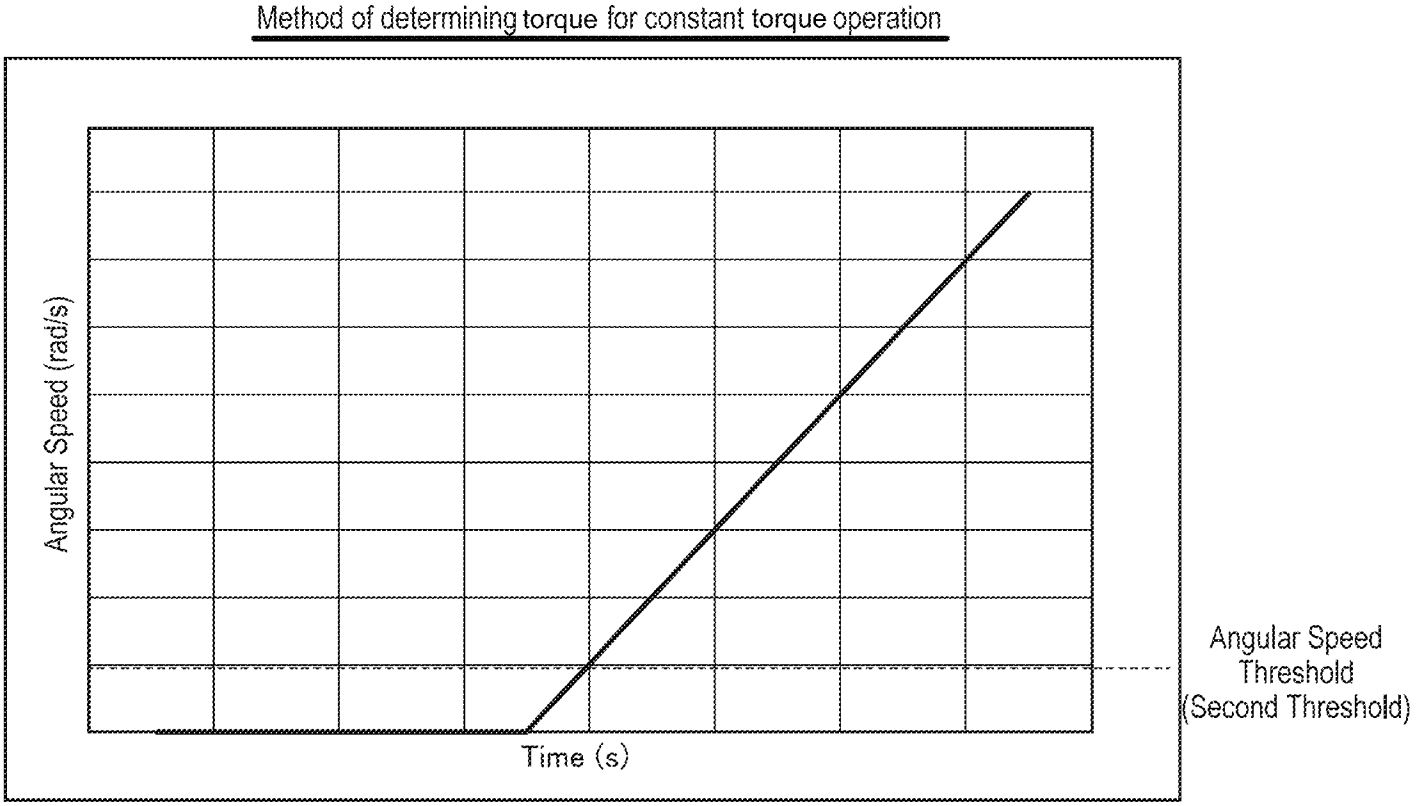
FIG. 12 is a graph for explaining a method of determining a torque for a constant torque operation in the transfer device according to an embodiment of the present invention.
Figure 13:
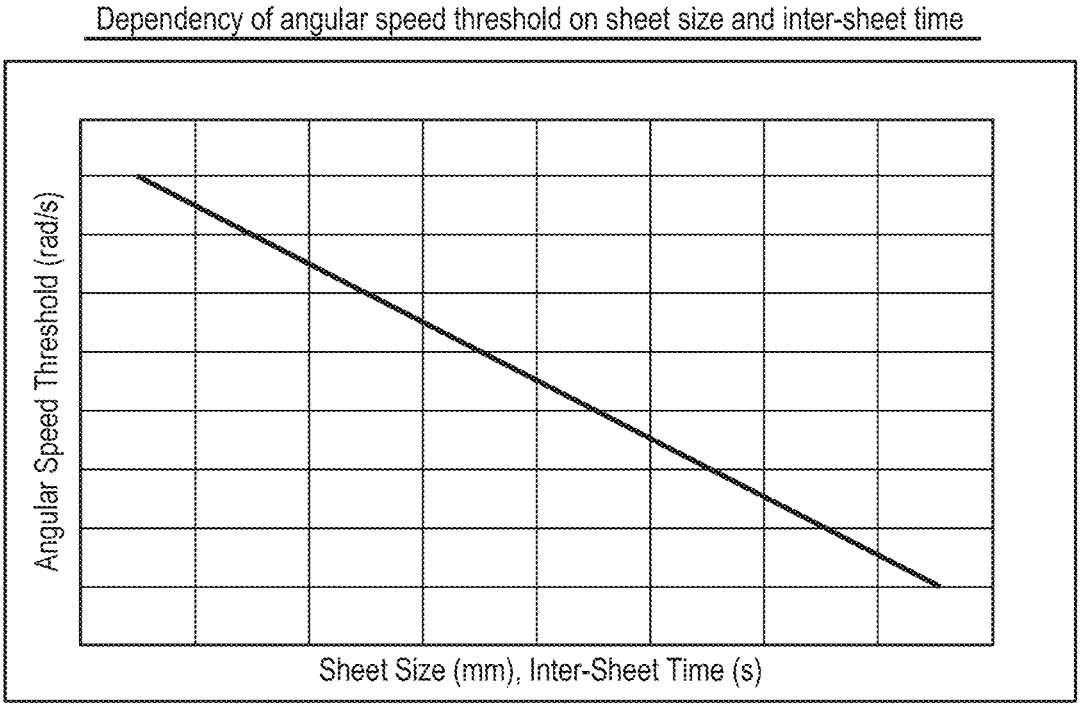
FIG. 13 is a graph illustrating dependency of a threshold for determining a torque for the constant torque operation on a sheet size or an inter-sheet time in the transfer device according to an embodiment of the present invention.

FIG. 12 is a graph for explaining a method of determining torque for a constant torque operation, and illustrates a temporal change in angular speed when the torque of the cam motor 93*c* is gradually increased. The controller 10 monitors the angular speed of the cam motor 93*c*, detects a point where the angular speed is more than or equal to the second threshold, and performs the constant torque operation with the torque at that time. In this case, as illustrated in FIG. 13, the second threshold is determined depending on the sheet size and the inter-sheet time. Specifically, when the sheet size is large, or when the inter-sheet time (time from when sheet is discharged from transfer nip to when next sheet enters transfer nip) is long, the time until the sheet is discharged from the transfer nip or the time until the next sheet enters the transfer nip becomes long, and thus the second threshold can be set to a small value, and the cam motor 93*c* can be operated at a low current.

Next, as the first control, the controller 10 determines whether the angular speed of the cam motor 93*c* is less than or equal to the predetermined threshold (first threshold) (S104). When the angular speed of the cam motor 93*c* exceeds the first threshold value (No at S104), the process returns to S103 and the constant torque operation is continued. When the angular speed of the cam motor 93*c* becomes less than or equal to the first threshold (Yes at S104), it is determined that the cam 93*a* abuts against the transmission mechanism 92 (secondary transfer roller 91 in configuration of FIG. 6), and the cam motor 93*c* is stopped (S105).

Figure 10:
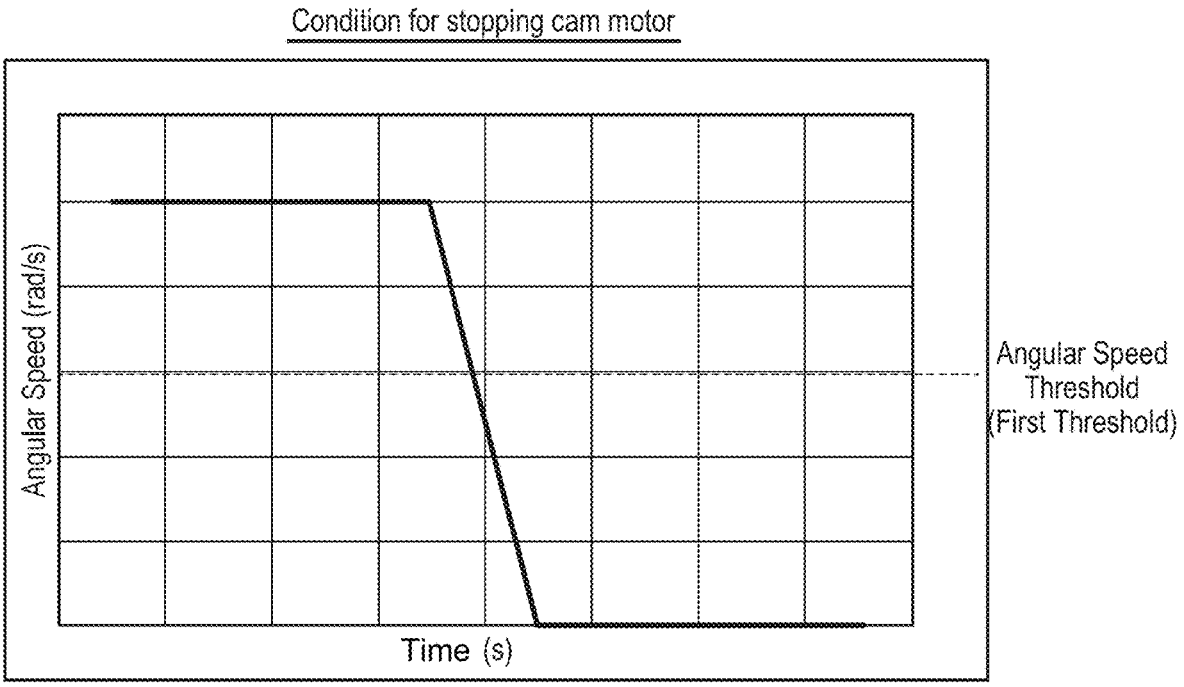
FIG. 10 is a graph for explaining a condition for stopping a cam motor in the transfer device according to an embodiment of the present invention.
Figure 11:
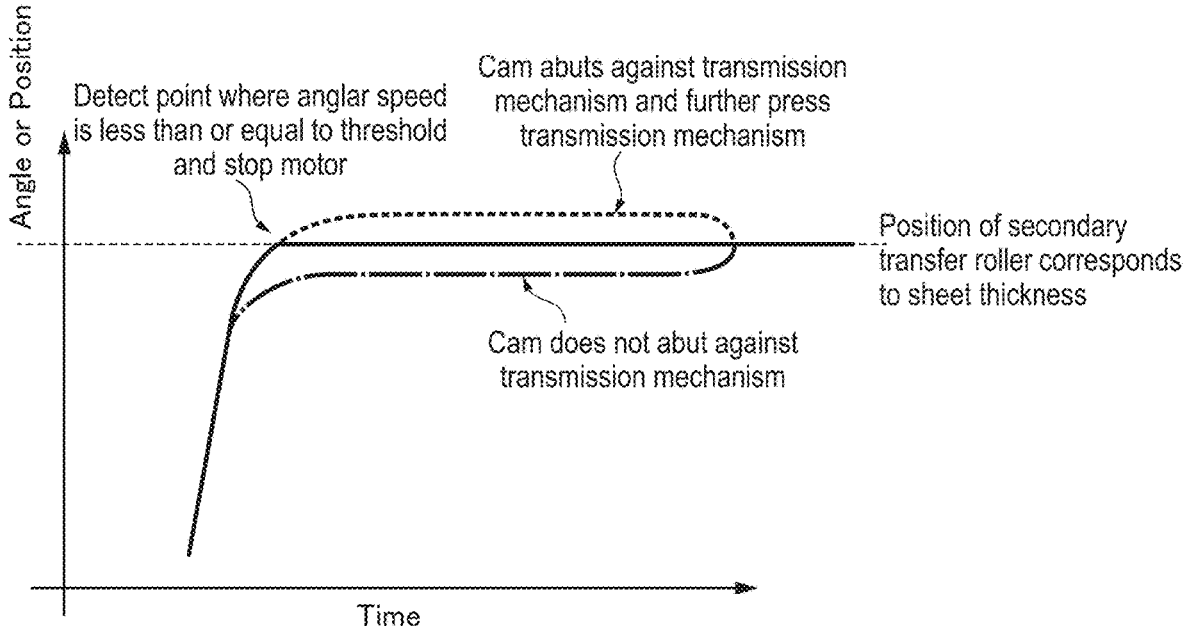
FIG. 11 is a graph for explaining a transfer method in the transfer device according to an embodiment of the present invention in comparison with a conventional method.

FIG. 10 is a graph for explaining a condition for stopping the cam motor 93*c*, and illustrates a temporal change in the angular speed of the cam motor 93*c* when the cam 93*a* abuts against the transmission mechanism 92 (or secondary transfer roller 91). The controller 10 monitors the angular speed of the cam motor 93*c*, detects a point where the angular speed is less than or equal to the first threshold, and stops the cam motor 93*c*. Such control is executed because, as illustrated in FIG. 11, in a method of stopping the operation of the cam motor 93*c* depending on the time, a distance between the intermediate transfer belt 90 and the secondary transfer roller 91 is sometimes smaller than a sheet thickness (state where cam 93*a* abuts against transmission mechanism 92 and further presses transmission mechanism 92: see fine broken line in FIG. 11) or the distance between the intermediate transfer belt 90 and the secondary transfer roller 91 is sometimes larger than the sheet thickness (state where cam 93*a* does not abut against transmission mechanism 92: see solid broken line in FIG. 11). As the cam motor 93*c* is stopped when the angular speed is less than or equal to the first threshold as described in the present embodiment, the distance between the intermediate transfer belt 90 and the secondary transfer roller 91 can be made to be equal to the sheet thickness (state where the cam 93*a* perfectly abuts against transmission mechanism 92) (see solid line in FIG. 11).

Next, as the second control, the controller 10 stores a position where the cam 93*a* abuts against the transmission mechanism 92 (or secondary transfer roller 91) (S106), and gradually rotates the cam 93*a* from that position, thus adjusting the transfer nip amount (S107). The transfer nip amount adjustment process when the recording medium enters the transfer nip is different from the transfer nip amount adjustment process when the recording medium is nipped between the intermediate transfer belt 90 and the secondary transfer roller 91.

FIG. 8 illustrates a transfer nip amount adjustment method when the recording medium enters the transfer nip. The controller 10 determines whether it is a timing for the recording medium to enter the transfer nip based on an output of a sensor disposed in the sheet conveying path or the like (S201). When it is the timing for the recording medium to enter the transfer nip (Yes at S201), the controller 10 drives the cam motor 93*c* so as to reduce the pressing force that presses the intermediate transfer belt 90 by the secondary transfer roller 91 within the range that the secondary transfer roller 91 is not separated from the intermediate transfer belt 90 (S202).

FIG. 9 illustrates a transfer nip amount adjustment method when the recording medium is nipped between the intermediate transfer belt 90 and the secondary transfer roller 91. The controller 10 determines whether it is a timing for the recording medium to be discharged from the transfer nip based on an output of the sensor disposed in the sheet conveying path or the like. (S211). When it is the timing for the recording medium to be discharged from the transfer nip (Yes at S211), the controller 10 drives the cam motor 93*c* so as to reduce the pressing force that presses the intermediate transfer belt 90 by the secondary transfer roller 91 within the range that the secondary transfer roller 91 is not separated from the recording medium (S212).

As described above, by executing the first control of operating the cam motor 93*c* with a constant torque and stopping the cam motor 93*c* when the rotation angular speed of the cam motor 93*c* is less than or equal to the first threshold and the second control of operating the cam motor 93*c* to adjusts the transfer nip amount, influence of motor torque variations and sheet thickness variations can be reduced, the transfer nip amount when the recording medium enters or exits the transfer nip can be adjusted appropriately, and image abnormalities due to fluctuations in the transfer nip amount can be prevented.

Note that the present invention is not limited to the embodiment described above, and the configuration and control can be changed appropriately without departing from the spirit of the present invention.

For example, in the above embodiment, whether the cam 93*a* abuts against the transmission mechanism 92 is determined on the premise of the configurations of FIG. 3 to FIG. 5. However, the transfer method of the present invention can be similarly applied to a case where whether the cam 93*a* abuts against the secondary transfer roller 91 is determined in the configuration of FIG. 6.

While the cam 93*a* is circular in the above embodiment, and the structure in which the camshaft 93*b* is disposed at a position shifted from the center of the cam 93*a* has been exemplified in the above embodiment, the shape of the cam 93*a* and the position of the camshaft 93*b* are not limited to the configurations of FIG. 3 to FIG. 6. For example, the cam 93*a* may have a shape in which a short diameter is different from a long diameter, and a structure in which the camshaft 93*b* is disposed at the center of gravity of the cam 93*a* may be employed.

The present invention can be used for an image forming apparatus including a transfer device that adjusts a pressing force that presses an intermediate transfer belt by a secondary transfer roller, using a cam, a transfer method using the image forming apparatus, a transfer control program operating in the image forming apparatus, and a recording medium recording the transfer control program.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, and a conveyor that conveys a recording medium to a transfer nip formed between said intermediate transfer belt and said secondary transfer roller, said image forming apparatus comprising:

a detector that detects a rotation angle of said motor; and a hardware processor that controls an operation of said motor, wherein said hardware processor executes first control of operating said motor with a constant torque and stopping said motor when a rotation angular speed of said motor is less than or equal to a first threshold determined in advance and second control of operating said motor at a predetermined timing to adjust a transfer nip amount.

2. The image forming apparatus as claimed in claim 1, wherein said hardware processor executes said first control before said recording medium enters said transfer nip.

3. The image forming apparatus as claimed in claim 2, wherein in said second control, immediately before said recording medium enters said transfer nip, said hardware processor drives said motor so as to reduce said pressing force within a range that said secondary transfer roller is not separated from said intermediate transfer belt.

4. The image forming apparatus as claimed in claim 1, wherein said hardware processor executes said first control in a state where said recording medium is nipped between said intermediate transfer belt and said secondary transfer roller.

5. The image forming apparatus as claimed in claim 4, wherein in said second control, immediately before said recording medium is discharged from said transfer nip, said hardware processor drives said motor so as to reduce said pressing force within a range that said secondary transfer roller is not separated from said recording medium.

6. The image forming apparatus as claimed in claim 1, wherein in said first control, said hardware processor drives said motor with a torque at a time when said rotation angular speed of said motor is more than or equal to a second threshold determined in advance.

7. The image forming apparatus as claimed in claim 6, wherein said second threshold is determined depending on an inter-sheet time or a sheet size.

8. The image forming apparatus as claimed in claim 1, wherein said transfer device further includes a transmission mechanism that includes a member whose one end is disposed at a position where said one end can abut against said cam and whose another end is disposed at a position where said another end can abut against said secondary transfer roller and a spring that is disposed at a position where said another end faces said secondary transfer roller, and in said second control, when said cam is separated from said one end of said member, said spring presses said another end of said member and thus said pressing force of said secondary transfer roller is increased, and when said cam presses said one end of said member, said another end of said member presses said spring, and thus said pressing force of said secondary transfer roller is reduced.

9. The image forming apparatus as claimed in claim 1, wherein in said first control, when said rotation angular speed of said motor at a predetermined time is less than a past rotation angular speed stored in advance, said hardware processor determines that said cam abuts against said secondary transfer roller or one end of said member.

10. A transfer method in an image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, a detector that detects a rotation angle of said motor, and a conveyor that conveys a recording medium to a transfer nip formed between said intermediate transfer belt and said secondary transfer roller, said transfer method comprising:

performing first processing of operating said motor with a constant torque and stopping said motor when a rotation angular speed of said motor is less than or equal to a first threshold determined in advance; and performing second processing of operating said motor at a predetermined timing to adjust a transfer nip amount.

11. The transfer method as claimed in claim 10, wherein said first processing is performed before said recording medium enters said transfer nip.

12. The transfer method as claimed in claim 11, wherein in said second processing, immediately before said recording medium enters said transfer nip, said motor is driven so as to reduce said pressing force within a range that said secondary transfer roller is not separated from said intermediate transfer belt.

13. The transfer method as claimed in claim 10, wherein said first processing is performed in a state where said recording medium is nipped between said intermediate transfer belt and said secondary transfer roller.

14. The transfer method as claimed in claim 13, wherein in said second processing, immediately before said recording medium is discharged from said transfer nip, said motor is driven so as to reduce said pressing force within a range that said secondary transfer roller is not separated from said recording medium.

15. The transfer method as claimed in claim 10, wherein in said first processing, said motor is driven with a torque at a time when said rotation angular speed of said motor is more than or equal to a second threshold determined in advance.

16. The transfer method as claimed in claim 15, wherein said second threshold is determined depending on an inter-sheet time or a sheet size.

17. The transfer method as claimed in claim 10, wherein said transfer device further includes a transmission mechanism that includes a member whose one end is disposed at a position where said one end can abut against said cam and whose another end is disposed at a position where said another end can abut against said secondary transfer roller and a spring that is disposed at a position where said another end faces said secondary transfer roller, and in said second processing, when said cam is separated from said one end of said member, said spring presses said another end of said member and thus said pressing force of said secondary transfer roller is increased, and when said cam presses said one end of said member, said another end of said member presses said spring, and thus said pressing force of said secondary transfer roller is reduced.

18. The transfer method as claimed in claim 10, wherein in said first processing, when said rotation angular speed of said motor at a predetermined time is less than a past rotation angular speed stored in advance, it is determined that said cam abuts against said secondary transfer roller or one end of said member.

19. A non-transitory computer-readable storage medium storing a transfer control program operating in an image forming apparatus that has a transfer device that includes an intermediate transfer belt that is tensioned by a plurality of support rollers, a secondary transfer roller that faces one of said support rollers with said intermediate transfer belt interposed between said one of said support roller and said secondary transfer roller, a cam that can adjust a pressing force that presses said intermediate transfer belt by said secondary transfer roller, a motor that drives said cam, a detector that detects a rotation angle of said motor, a controller that controls an operation of said motor, and a conveyor that conveys a recording medium to a transfer nip formed between said intermediate transfer belt and said secondary transfer roller, said transfer control program causing said controller to perform:

first processing of operating said motor with a constant torque and stopping said motor when a rotation angular speed of said motor is less than or equal to a first threshold determined in advance; and second processing of operating said motor at a predetermined timing to adjust a transfer nip amount.

* * * * *